US010974892B1

(12) United States Patent
Zafir et al.

(10) Patent No.: US 10,974,892 B1
(45) Date of Patent: Apr. 13, 2021

(54) INTERMEDIATE BULK CONTAINER CARTRIDGE

(71) Applicants: Monroe Zafir, Monsey, NY (US); Brian Zafir, Monsey, NY (US)

(72) Inventors: Monroe Zafir, Monsey, NY (US); Brian Zafir, Monsey, NY (US)

( * ) Notice: Subject to any disclaimer, the term of this patent is extended or adjusted under 35 U.S.C. 154(b) by 0 days.

(21) Appl. No.: 15/939,214

(22) Filed: Mar. 28, 2018

Related U.S. Application Data

(60) Provisional application No. 62/477,833, filed on Mar. 28, 2017.

(51) Int. Cl.

| | |
|---|---|
| ***B65D 88/16*** | (2006.01) |
| ***B65D 75/58*** | (2006.01) |
| ***B65D 90/14*** | (2006.01) |
| ***B65D 77/06*** | (2006.01) |

(52) U.S. Cl.
CPC ..... *B65D 88/1618* (2013.01); *B65D 88/1656* (2013.01); *B65D 75/5877* (2013.01); *B65D 77/06* (2013.01); *B65D 88/1668* (2013.01); *B65D 90/146* (2013.01); *B65D 2590/046* (2013.01)

(58) Field of Classification Search
CPC ..... B65D 88/1618; B65D 88/1656; B65D 77/065; B65D 77/062; B65D 5/441; B65D 5/566; B65D 5/72; B65D 77/06; B67D 1/0462
USPC ..... 229/117.27, 117.3, 117.35, 122.32; 222/105, 92; 220/495.05, 495.01, 495.06, 220/495.08; 206/594; 221/302
See application file for complete search history.

(56) References Cited

U.S. PATENT DOCUMENTS

| | | | | | |
|---|---|---|---|---|---|
| 3,054,549 | A * | 9/1962 | Humphrey | B65D 77/065 | 229/117.13 |
| 3,119,544 | A * | 1/1964 | Cope | B65D 5/4608 | 206/594 |
| 4,796,788 | A * | 1/1989 | Bond | B65D 77/067 | 222/105 |
| 4,815,631 | A * | 3/1989 | Eeg | B65D 5/4608 | 222/183 |
| 5,562,227 | A * | 10/1996 | Takezawa | B65D 5/5021 | 229/109 |
| 5,860,555 | A * | 1/1999 | Mayled | B65D 5/6608 | 220/495.05 |
| 6,648,218 | B2 * | 11/2003 | Katsuyama | G03G 15/0874 | 220/495.06 |
| 7,708,186 | B2 * | 5/2010 | Pawlick | B65D 77/062 | 220/495.05 |
| 7,984,845 | B2 * | 7/2011 | Kelly | B65D 5/4608 | 222/105 |
| 8,033,447 | B2 * | 10/2011 | Katoh | G03G 15/0874 | 229/101 |
| 8,261,964 | B2 * | 9/2012 | Raupach | B65D 77/065 | 229/117.3 |

(Continued)

*Primary Examiner* — Christopher R Demeree
(74) *Attorney, Agent, or Firm* — Calhelha & Doyle LLC

(57) ABSTRACT

A cartridge assembly for deploying a fillable bulk liquid bag in an intermediate bulk container is provided. The cartridge has a flexible reinforcing board adhered to the fillable bag which may facilitate securing the bag to the discharge port of an IBC while also directing the bag to the IBC bottom center for more efficient filling. Sacrificial paper tape may be used to maintain the cartridge for storage, transportation and deployment in an IBC.

14 Claims, 10 Drawing Sheets

(56) References Cited

U.S. PATENT DOCUMENTS

| | | | | |
|---|---|---|---|---|
| 8,276,806 | B2 * | 10/2012 | Burke | B65D 77/062 222/92 |
| 8,651,365 | B2 * | 2/2014 | Lymn | B65D 5/04 137/343 |
| 8,939,351 | B2 * | 1/2015 | Goudreau | B65D 77/065 229/117.3 |
| 9,016,555 | B2 * | 4/2015 | Plunkett | B65D 77/065 220/666 |
| 9,758,285 | B2 * | 9/2017 | Brooks | B65D 75/5877 |
| 10,118,751 | B2 * | 11/2018 | Couvillon | B65D 77/065 |
| 2006/0180643 | A1 * | 8/2006 | Stephenson | B65D 5/46008 229/117.3 |
| 2007/0228127 | A1 * | 10/2007 | Gardner | B65D 5/327 229/122.23 |

* cited by examiner

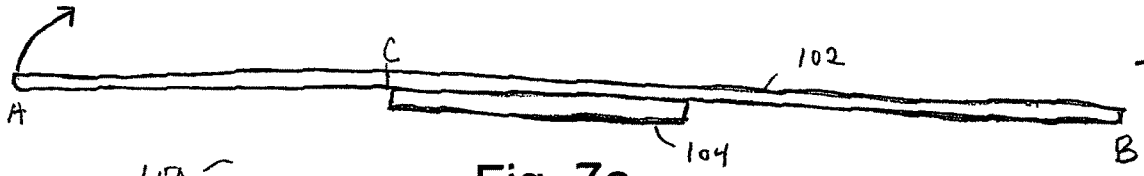
Fig. 7a
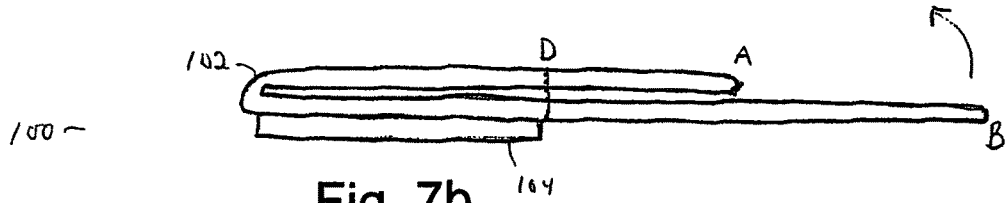
Fig. 7b
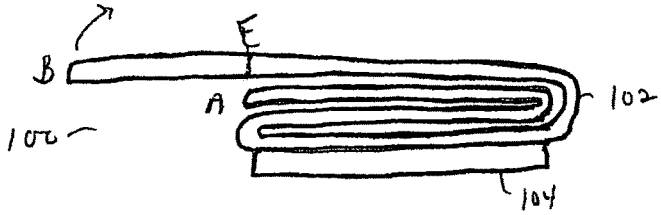
Fig. 7c
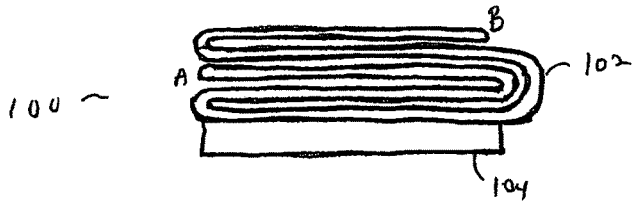
Fig. 7d
Fig. 7

INTERMEDIATE BULK CONTAINER CARTRIDGE

CROSS-REFERENCE TO RELATED APPLICATION

This application claims the benefit of co-pending provisional patent application Ser. No. 62/477,833 filed Mar. 28, 2017 and which is incorporated herein by reference in its entirety.

FIELD OF THE INVENTION

The present invention relates to an apparatus for deploying a fillable bulk liquid bag in an intermediate bulk container.

BACKGROUND OF THE INVENTION

IBC is an acronym for intermediate bulk containers (IBC). IBCs are used for both liquid and dry containers which contain less than a full truck load but more than 1000 lbs. of product. IBCs include totes of various types but a particularly useful design is the bag-in-box version utilizing a pillow bag or pillow liner.

A pillow bag or pillow liner is a bag or liner designed to hold liquid in an IBC and conforms to the shape of the interior of the container. Typically, such liners are formed by welding (heat sealing) 2-6 layers of plastic film sheeting (usually polyethylene or multi-layer barrier films) along all four sides of the film. Fittings, usually 2 ports, are attached to half the layers of the film to facilitate filling and emptying of the product contents of the IBC.

When using a conventional pillow liner, a discharge fitting is attached near the bottom of the IBC where a discharge hole is located in the IBC to accept the discharge fitting. As the liner is being filled it must manually be adjusted to ensure that the liner will conform to the walls of the IBC. Failure to properly adjust the pillow will result in not being able to fill the IBC to capacity.

Examples of conventional IBCs are seen in U.S. Pat. Nos. 7,798,711 and 9,346,612 both of which are incorporated herein in their entirety. Another option to fill a liquid IBC is to provide a form and fit bag. Conventional IBCs, bags, parts and fitments are widely available. See, for example, bulk liquid shipping products from CDF Corporation, Plymouth, Mass.

Note that pillow type bags can be made with 4-6 seals whereas form and fit type bags typically will have 16 heat seals, thereby increasing costs while decreasing reliability.

SUMMARY OF THE INVENTION

In accordance with the detailed description below, there is provided a self-forming pillow bag and cartridge for deploying said bag in an intermediate bulk container application.

The subject cartridge combines a piece of reinforcing board with a flexible pillow bag adhered and folded thereon and is configured so that the board receives the bag's lower discharge port which is to be secured to a lower area of an IBC side discharge panel. A fold or score line on the reinforcing board and below the discharge port is configured to convey the lower portion of the fillable bag to the center of the IBC base. The opposite or upper end of the cartridge carries a major portion of the fillable bag vertically to facilitate filling.

The bottom end of the pillow bag is aligned at the bottom edge of the reinforcing board, along the narrow width of the board. The reinforcing board or reinforcing cardboard is secured to the pillow bag with adhesive such as tape or glue or hot melt plastic, and the board and bag together comprise the deployable cartridge.

During manufacturing of the cartridge, the fillable bag is adhered to the reinforcing board and will lie generally flat across the board until it is folded atop the board. As the empty flattened fillable bag will be significantly larger in dimension relative to the reinforcing board, the excess film that extends beyond the side edges of the reinforcing board is folded onto the reinforcing board in any of several configurations, as described below. Folding techniques may include pleating, fan folding, accordion style folding, symmetrical "W" patterns, or side to side sequential folding. The excess film that extends beyond the top edge of the vertical panel of the reinforcing board may be folded over that end of the panel down towards the bottom panel. Then the bottom panel and bag adhered thereto can be folded over to complete the ready to deploy cartridge.

A series of light sacrificial tapes may be placed across or around the reinforcing board and bag folds to keep the cartridge and fillable bag from unfolding. Tapes of paper or tearable plastic are suitable for this purpose.

The cartridge is ready for use and can be deployed in an IBC by aligning the vertical panel of the reinforcing board with the discharge panel of the IBC and securing the discharge fitting from the flexible bag, through the reinforcing board of the cartridge, and to the IBC.

Accordingly, the cartridge is placed in the IBC. The discharge fitting is attached to the discharge hole of the IBC. The bottom of the reinforcing board unfolds taking the bottom of the pillow bag with it to the center of the bottom of the IBC. Preferably, a filling adapter as described below is inserted into an input port of the bag to facilitate efficient filling. In any case, the IBC fill fitting is attached to the customer's filling apparatus for completion of the filling process with a selected liquid product.

In some conventional cartridges the fill hose must rise as the bag is being filled. In the present design, as the bag fills, the cartridge filling apparatus can be in a fixed position. The top of the subject bag fill fitting need only be lightly secured as the bag is being filled. As the bag is being filled, the bag is secured to the discharge side of the IBC. This causes the liquid to spread the bag around the IBC base, and as the bag fills, the sacrificial tapes are broken. As the IBC fills the liquid conforms the bag to the walls of the IBC until the IBC is filled.

Other objects, features and advantages of the present invention will be apparent when the detailed descriptions of the preferred embodiments of the invention are considered with reference to the accompanying drawings, which should be construed in an illustrative and not limiting sense as follows.

BRIEF DESCRIPTION OF THE DRAWINGS

FIG. 7 is a cross-sectional view of a folding technique for the subject cartridge assembly. FIG. 7 *a* is a cross-sectional view of a step of the folding technique for the subject cartridge assembly FIG. 7 *b* is a cross-sectional view of a step of the folding technique for the subject cartridge assembly.

FIG. 7 *c* is a cross-sectional view of a step of the folding technique for the subject cartridge assembly.

FIG. 7 *d* is a cross-sectional view of a step of the folding technique for the subject cartridge assembly.

DETAILED DESCRIPTION OF THE PREFERRED EMBODIMENTS

Figure 1:
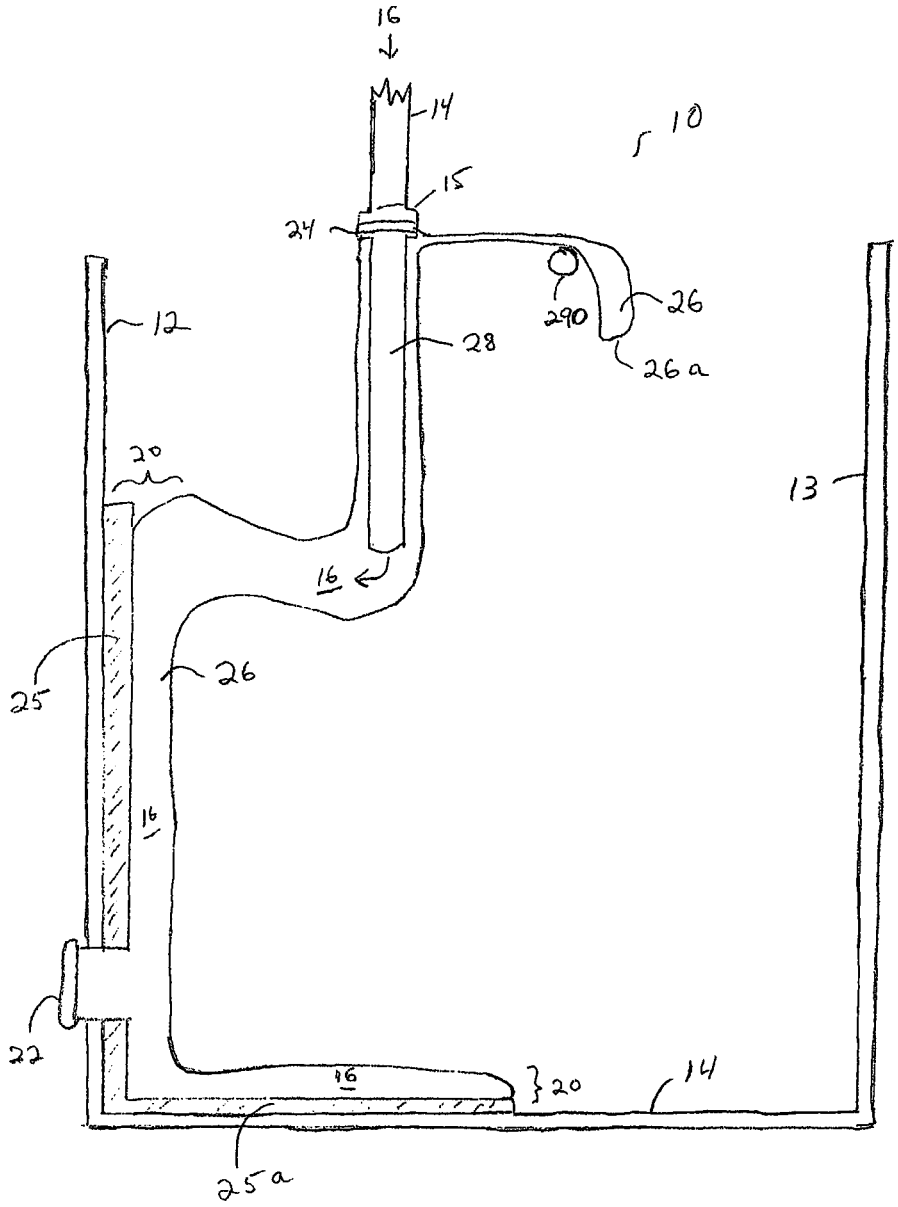
FIG. 1 is a cross-sectional view of the subject cartridge assembly for deploying a fillable bulk liquid bag in an intermediate bulk container.

The subject improved apparatus has several important elements as detailed herein below. Materials are selected for strength and performance in a given IBC application, particularly volume requirements for liquid contents, transportation and final usages and disposition of materials.

The subject apparatus is a cartridge for deploying a flexible plastic liquid fillable bag within an intermediate bulk container (IBC) shipping container. Although IBCs come in a variety of sizes and shapes, the subject cartridge has found particular utility in the processed food business where liquid products such as eggs and cooking oils are shipped in bulk to processing customers.

A typical IBC for egg products can contain 235 gallons of liquid eggs and would have a pair of opposite side panels 47 in. wide, a pair of narrower side panels 40 in. wide and a panel height of 36 in. high. Oil products will typically be shipped in a 275 gallon or 1000 liter IBC which has the same side panel widths as above but the panels have a vertical height of 41 in.

Such IBCs are generally configured for use with standard 40 in. by 48 in. shipping pallets. Many IBCs will therefore be rectangular in shape but the subject bag deployment cartridge also can be used with square or even octagon shaped containers.

The deployment cartridge has a reinforcing board adhered to the flexible fillable bag. The fillable bag will generally have industry standard dimensions corresponding to the volume of liquid product it is intended to contain.

The reinforcing board will derive its dimensions from the IBC for which it is designed. This IBC will have a discharge hole centered near the bottom of one vertical side panel. This panel is designated herein as the discharge panel and it will determine the reinforcing board dimensions as follows.

The reinforcing board is a rectangle having a fold line across the narrow dimension thereby defining two sub-panel areas: a first or bottom panel which later will be deployed on the bottom of the IBC, and a second or vertical panel which will later be installed vertically along the inside of the IBC discharge panel.

The height of the vertical panel of the reinforcing board will be at least half the height of the IBC, and preferably about two-thirds of such height. In some applications the vertical panel can be 100 percent of the IBC height, or even more if the board is thereafter folded over to permit closure of the IBC.

Near the fold line, the vertical panel will have a centered hole permitting access to the bag discharge valve and corresponding to the hole in the IBC discharge side panel.

The reinforcing board bottom panel will have a length from the fold line to the narrow edge and which corresponds to the distance from the center of the IBC base or bottom panel to the discharge side panel. Thus, the long dimension of the reinforcing board corresponds to the sum of (a) the distance from the center of the IBC base or bottom panel to the discharge side panel, plus (b) the height selected for the vertical panel, as discussed above.

The width of the reinforcing board is determined by the dimensions of the IBC discharge panel. The reinforcing board can be no wider than the width of of the IBC side discharge panel. Typically, the width of the reinforcing panel will be about 30-50 percent, and preferably about 40 percent of the width of the discharge panel.

FIG. 1 is cross-sectional elevation view of an assembly 10 of the subject cartridge 20 for deploying a fillable bulk liquid bag 26 in an intermediate bulk container (IBC) having vertical side panels 12 and 13 and horizontal base or bottom panel 14. IBC totes are manufactured from a variety of materials, corrugated paperboard being preferred in the present application. Cartridge 20 is provided by affixing fillable bag 26 to cartridge reinforcing board 25. Preferably, cartridge reinforcing board 25 is a corrugated paperboard panel dimensioned as described below. Cartridge reinforcing board 25 will have a folding aspect such that a lower section or panel 25*a* thereof can lie horizontally at the base of the IBC while directing the far or bottom end of fillable bag 26 to the center of the IBC. The opposite end of the folded cartridge reinforcing board 25 will rise vertically along part or all of a vertical side panel of the IBC, such as panel 12 shown here. The vertical panel of reinforcing board 25 will rise at least midway up the side panel of the IBC, and preferably will rise about two thirds of the vertical dimension of the IBC.

In FIG. 1, the fillable bag 26 is filled by connection of input port 24 to fill nozzle 15 and liquid product fill line 14. Filling tube 28 facilitates the filling operation by initially directing liquid product 16 toward the lower sections of bag 26 as it unfolds and conforms to the interior of the IBC. This procedure further serves to avoid early and inadvertent filling of the upper end 26*a* of fillable bag 26. Optionally, a jig may be utilized to hold the upper end of bag 26 away from the fill zone. A simple version of such a jig would be a dowel or rod 290, shown here in cross-section but which is deployed across the upper opening of the IBC and thereby supported by the opposite walls of the IBC. Also shown is a discharge valve or exhaust port 22, generally used by a customer to obtain liquid product as required.

Figure 2:
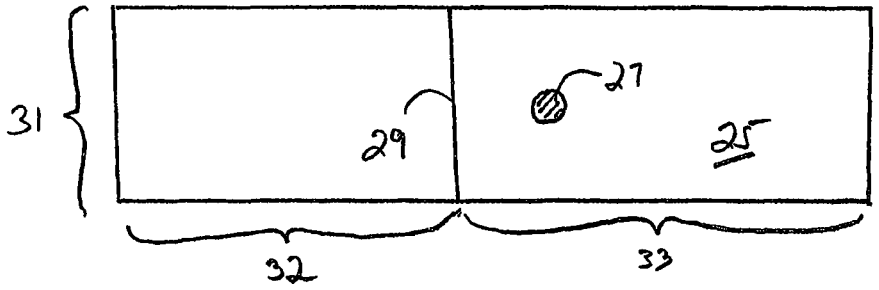
FIG. 2 is a plan view of the cartridge reinforcing member used in FIG. 1.

FIG. 2 is a plan view of the cartridge reinforcing board 25 used in FIG. 1. Board 25 depicts hole or void 27 for later introduction of the bag discharge port. Board 25 has a line 29 which is a score or fold line dividing a subsequent lower portion of the cartridge which lies horizontally on the base of an IBC from an upper portion of the cartridge which is subsequently aligned vertically with a side panel of the IBC. Dimension 31 of board 25 represents the width of a selected IBC side panel having a hole for a discharge port and where the cartridge will be deployed to fill the bag. Some IBCs are symmetrical and each panel will have the same width. Other IBC totes have alternating wide and thin panels. It is in these such IBCs that care is taken to utilize a cartridge having the correct width of the reinforcing panel. Dimension 32 represents the distance from the side panel of the IBC to its center location, thereby urging the fillable bag to the center of the IBC to be filled. Dimension 33 of the reinforcing board is the portion running vertically up one side panel of the IBC. It is generally preferred that the reinforcing panel 25 rise about 60-70% of the height of the side panel. However, in some embodiments, the reinforcing board may rise higher, even to the top of the panel. In the latter case, the reinforcing board may also have a small additional amount of material which can overlap the top of the IBC and be adhered to the outside thereto during a filling operation.

Figure 3:
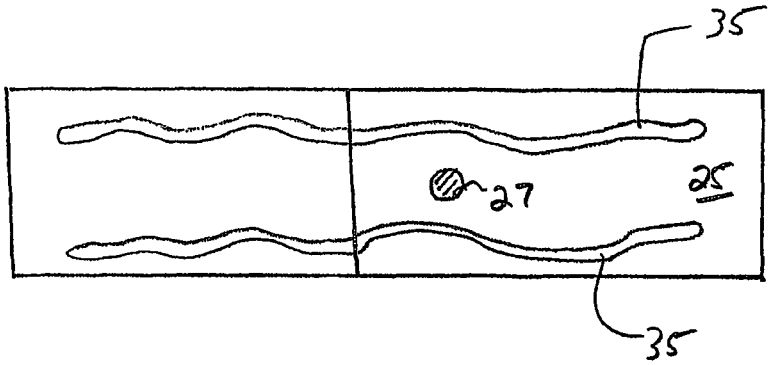
FIG. 3 is a further plan view of cartridge reinforcing member shown in FIG. 2.

FIG. 3 is a further plan view of cartridge reinforcing board 25 shown in FIG. 2. In this depiction, adhesive glue 35 has been applied to one face of board 25 awaiting a fillable bag to be adhered thereto.

Figure 4:
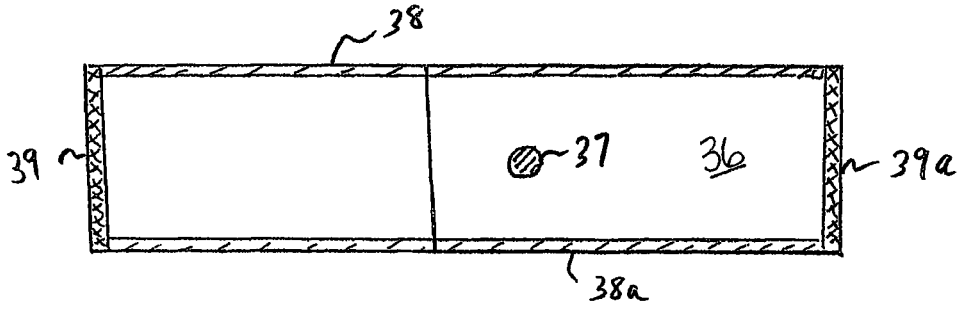
FIG. 4 is an alternative plan view of a cartridge reinforcing member.

FIG. 4 is an alternative plan view of cartridge reinforcing board 36. It has aperture 37 and application of opposite adhesive tape strips 38-38*a* and 39-39*a* which are utilized to attach a fillable bag without application of glue on the reinforcing board 36.

Figure 5:
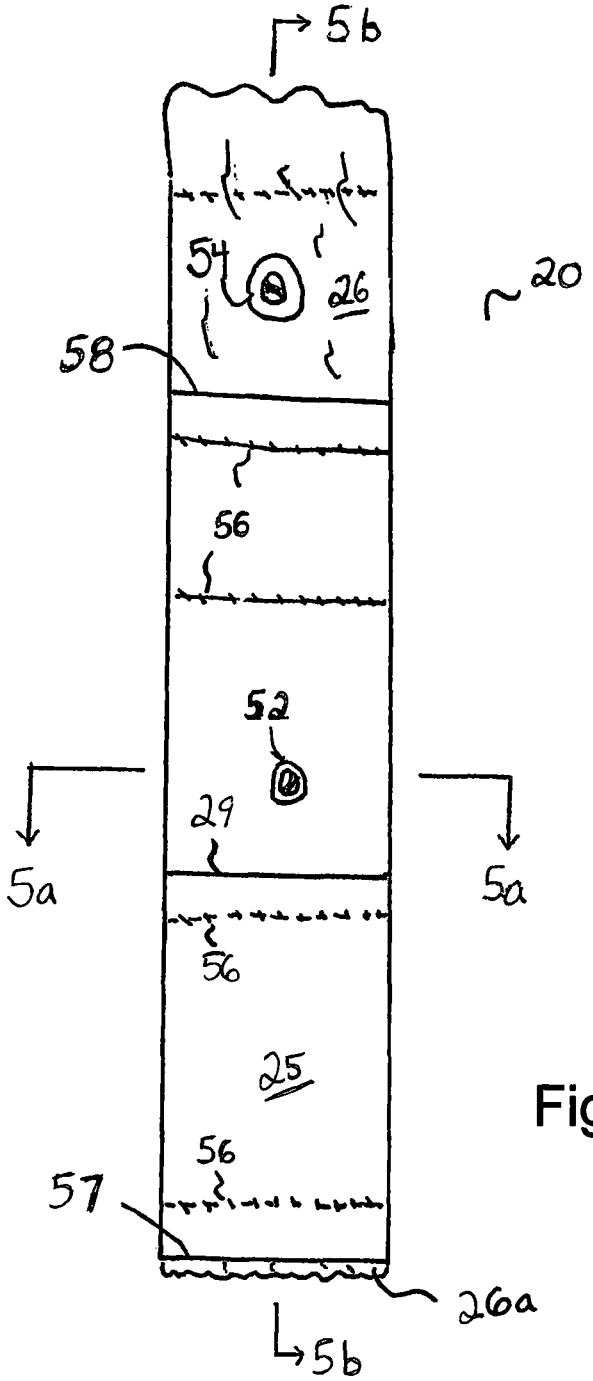
FIG. 5 is a plan view of the subject cartridge for deploying a fillable bulk liquid bag in an intermediate bulk container combining a cartridge reinforcing member and a fillable bag.

FIG. 5 is a plan view of the subject cartridge assembly 20 for deploying a fillable bulk liquid bag 26 having fill port 54 at one end. In this view, distal portion 26*a* of bag 26 is seen at the opposite end of the assembly, the bag 26 being adhered below reinforcing board 25. Reinforcing board 25 depicts several features including opposite edges 57-58 seen in further detail below. Board 25 also has fold or score line 29 and discharge port 52. Lastly, here, 5 optional strips of sacrificial paper or masking tape 56 are seen running across the upper board and bag. These continue around and below the assembly to gather and secure the fillable bag. These may be used to keep the cartridge in a neat state for storage, shipment and while being deployed, yet the sacrificial tape will easily burst as the bag is filled within the IBC.

Figure 5A:
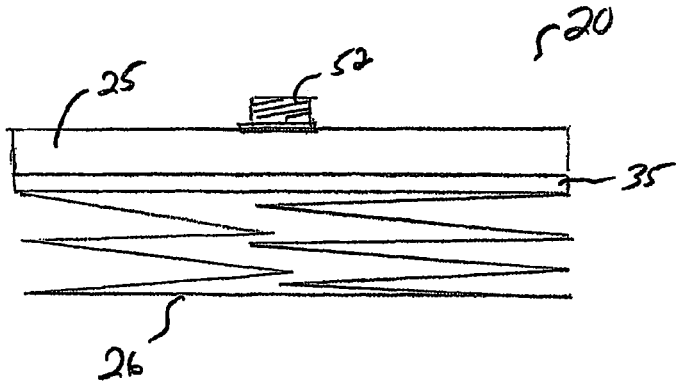
FIG. 5*a* is a cross-sectional view depicting details of the subject cartridge for deploying a fillable bulk liquid bag.
Figure 5B:
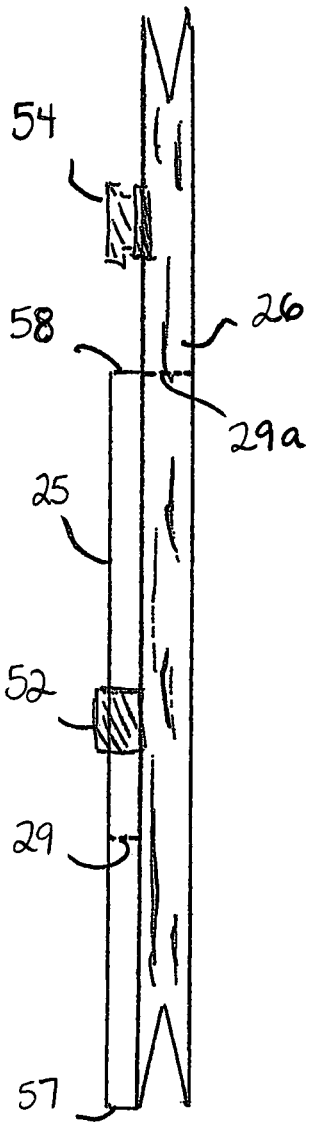
FIG. 5*b* is a cross-sectional view depicting details of the subject cartridge for deploying a fillable bulk liquid bag.

FIGS. 5*a* and 5*b* are cross-sectional views depicting details of the cartridge 20 depicted in FIG. 5. In FIG. 5*a*, cartridge assembly 20 shows a cross section of corrugated reinforcing board 20 having discharge port 52 installed thereon. Board 25 is adhered to fillable bag 26 via glue layer 35 (shown not to scale). In this embodiment, fillable bag 26 is shown in fan-folded style.

FIG. 5*b* depicts a lengthwise cross-section of cartridge assembly 20. In this view, reinforcing board 25, having opposite end edges 57-58, also has discharge port 52 installed therein. Fillable bag 26, having several folds and undulations in its lengthwise aspect, is shown adhered to reinforcing board 25, whereby its upper end beyond reinforcing board 25 has fill port 54. In this view, folding points 29 and 29*a* are depicted.

Figure 6:
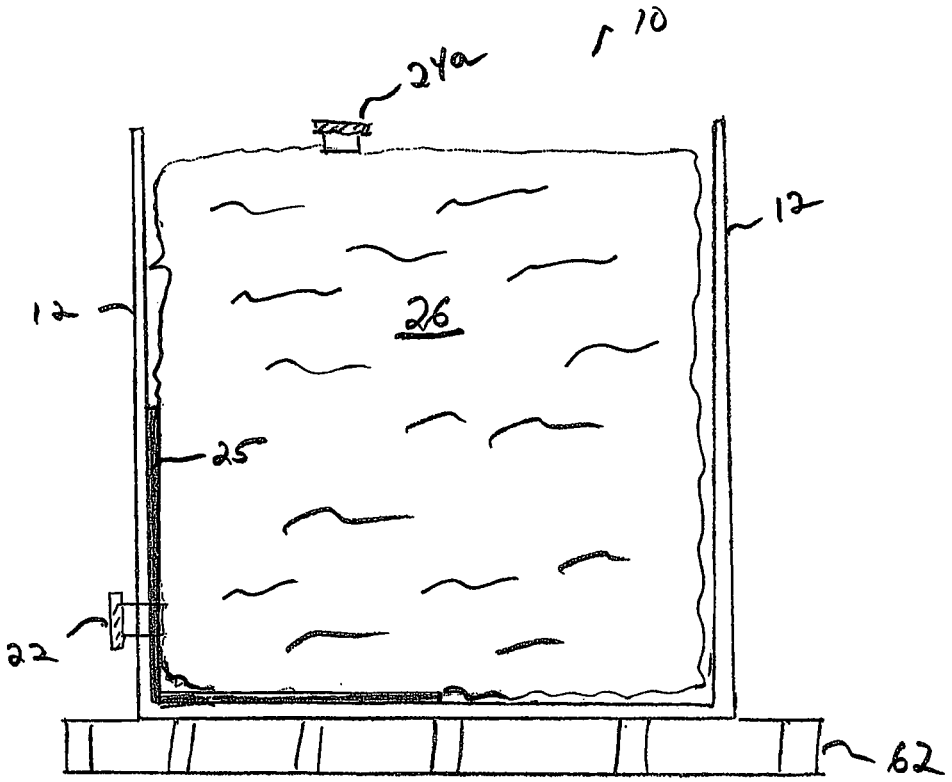
FIG. 6 is an elevation view of a cross-section depiction detailing the deployed cartridge assembly, deployed and filled with liquid.

FIG. 6 is an elevation view of a cross-section schematic detailing an IBC tote and deployed cartridge assembly 10, after it is filled with a liquid product. Filled bag 26 conforms to IBC side panels 12. Unfolded reinforcing board 25 is seen near discharge port 22. The filled IBC sits atop pallet 62 for transport. For illustrative purposes, the wrinkly character of the filled bag is exaggerated; in practice it would be nearly flush with surfaces of the IBC side panels. Conventionally, IBCs will be covered for shipping or stacking and are often fitted with reinforcing straps.

FIG. 7 depicts a cross-sectional view of the steps of a folding technique for the IBC cartridge. FIG. 7*a* depicts IBC cartridge 100 before it is folded for deployment in an IBC. In this end-on elevation view, the discharge end of fillable bag 102 is laid atop reinforcing board 104 and adhered thereto. This configuration will permit a first fold of the fillable bag transversely from point A toward point B while folding or pivoting at point C.

FIG. 7*b* further depicts the direction of the next fold where the opposite longitudinal edge depicted by point B is folded back across the cartridge, carrying the bag portion at labeled point A along with it, as it pivots or folds at point D.

FIG. 7*c* depicts a remnant of the fillable bag at point B which is then folded over at point E to complete the folded cartridge assembly, as seen in FIG. 7*d*. For simplicity, the fill and discharge valves are not depicted in this end-on view.

Figure 8:
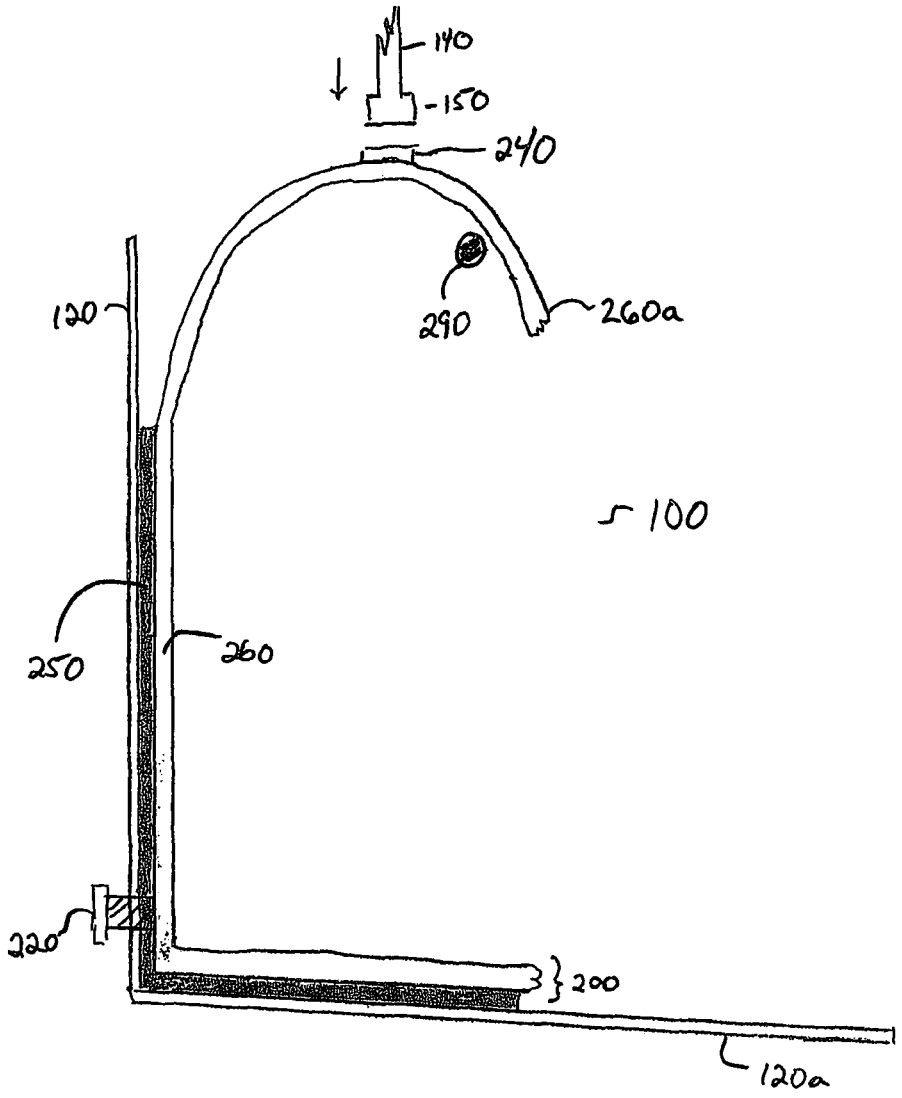
FIG. 8 is a cross-sectional view of an alternative cartridge assembly for deploying a fillable bulk liquid bag in an intermediate bulk container.

FIG. 8 is partial cross-sectional view of an assembly 100 of another embodiment of the subject cartridge 200 for deploying a fillable bulk liquid bag 260 in an intermediate bulk container having vertical side panel 120 and horizontal base panel 120*a*.

Cartridge 200 is provided by affixing fillable bag 260 to cartridge reinforcing board 250. Preferably, cartridge reinforcing board 250 is a corrugated paperboard panel dimensioned as described below. Cartridge reinforcing board 250 will have a folding aspect such that a lower section thereof can lie horizontally at the base of the IBC while directing the far end of fillable bag 260 to the center of the IBC. The opposite end of the folded cartridge reinforcing board 250 will rise vertically along part or all of IBC vertical side panel 120.

In FIG. 8, the fillable bag 260 will be filled after connection of input port 240 to fill nozzle 150 and liquid product fill line 140. Also shown is discharge or exhaust port 220, generally used by a customer to obtain liquid product as required. Optionally, a jig may be utilized to hold the upper end of bag 260 away from the fill zone. A simple version of such a jig would be a dowel or rod 290, shown here in cross-section but which is deployed across the upper opening of the IBC and thereby supported by the opposite walls of the IBC.

For many applications, a preferred pillow bag can be fabricated from a double sleeve of polyethylene film, the film can be 0.00325 in. thick, but many other films and thicknesses can be utilized. In some applications barrier films are used. The seams can be impulse sealed with electricity or heat.

In some applications, the width of the reinforcing board can be up to slightly smaller than the width of the box panel upon which it will be deployed. IBCs are available in a variety of sizes and configurations, including, but not limited to, square, rectangle, and octagon. In the rectangular or octagonal configurations, the sides may have alternating wide and narrow side panels, and the discharge valve would typically be located on one of the narrow side panels. For example, if the IBC is 40 in.×48 in., the discharge valve typically will be on a 40 in. panel. Therefore, the width of the cartridge and its reinforcing board must be less than 40 in. and preferably will be less than half of the IBC discharge panel, which in this case would be less than 20 in.

EXAMPLE 1: A rectangular 235 gallon IBC had a pair of 47 in. panels and a pair of 40 in. panels, one of which was its discharge panel. The IBC was 36 in. in height. A cartridge for deploying a fillable bag in the IBC had a corrugated paperboard reinforcing board 20 in. wide and 46 in. long. The reinforcing board used in the cartridge was approx. 0.20 in. thick. A hole was made in the reinforcing board, and the discharge fitting attached to a fillable pillow bag was put through the reinforcing board. A score or fold line was made across the reinforcing board, at the center line between the distal ends of the reinforcing board, in this case 23" from each end. The pillow bag was glued to the reinforcing board and folded atop the reinforcing board and then secured with six strips of sacrificial paper tape. When the discharge valve on the fillable bag was secured to the IBC discharge panel, the cartridge was vertically aligned with the inside surface of the IBC discharge panel. The cartridge reinforcing fold was aligned with the corner crease of the discharge panel and the IBC bottom panel. The cartridge was unfolded by urging it in the direction of the IBC bottom center and breaking the sacrificial tapes holding the cartridge in its folded configuration. Thereafter, the IBC is filled with liquid product as the fillable bag expands, breaking any remaining sacrificial tape, and conforms to the inner geometry of the IBC.

EXAMPLE 2: A rectangular 275 gallon IBC had a pair of 47 in. panels and a pair of 40 in. panels, one of which was its discharge panel. The IBC was 41 in. in height. A cartridge for deploying a fillable bag in the IBC had a corrugated paperboard reinforcing board 20 in. wide and 51 in. long. The reinforcing board used in the cartridge was approx. 0.20 in. thick. A hole was made in the reinforcing board, and the discharge fitting attached to a fillable pillow bag was put through the reinforcing board. A score or fold line was made across the reinforcing board at the center line, between the opposite distal ends of the reinforcing board, in this case 25.5 in. from each end. The pillow bag was glued to the reinforcing board and folded atop the reinforcing board and then secured with six strips of sacrificial paper tape.

If desired, the cartridge can be adhered to the IBC vertical discharge panel with, for example, a piece of two sided tape. This will decrease the necessity of holding the bag while the bottom is forming. Alternatively, a simple jig made of plastic, wood or metal could be installed across the open top of the IBC to secure or hang the upper end of the bag to be filled, to prevent it from falling within the IBC. As mentioned previously, a wooden dowel placed across the top opening of the IBC may be used for this purpose.

Another alternative for supporting the upper fill-end of the bag would be to use a longer reinforcing board. The longer board can rise slightly higher than the vertical IBC side panel and be secured by folding over its top edge.

As used herein, and depending on context, the term IBC may refer to either the container and bag deployed therein, or alternatively, may refer to the outer container only.

The invention now being fully described, it will be apparent to one of ordinary skill in the art that many changes and modifications can be made thereto without departing from the spirit or scope of the invention set forth herein.

The invention claimed is:

1. A cartridge for deploying a liquid fillable bag within an intermediate bulk container (IBC) having a geometry or shape comprising:

a flexible reinforcing board adhered to a generally flat and flexible fillable bag, wherein the fillable bag has a bottom and a top and has dimensions corresponding to a selected volume of liquid product it is intended to contain and the reinforcing board has dimensions corresponding to the geometry of the IBC, and said IBC has a side discharge panel having a height and a bottom, and said IBC has a discharge hole centered near the bottom of said side discharge panel, said discharge hole being configured to accommodate and secure a discharge fitting;

and wherein the reinforcing board is a rectangle having a fold line across its narrow dimension thereby defining only two sub-panel areas including a first or bottom panel adhered to a bottom edge of the fillable bag and configured to urge the bottom of said fillable bag to the bottom center of the IBC, and a second or vertical panel having a discharge fitting hole centered to correspond to the IBC side discharge panel, said vertical panel having a height of at least one-half the height of said side discharge panel and said vertical panel having a width of less than said side discharge panel;

and wherein said reinforcing board is configured to facilitate filling of said fillable bag deployed within said IBC and upon said IBC bottom panel permitting unfolding of said bottom of said fillable bag during a filling operation and is further configured to orient the fillable bag along the corresponding discharge side panel of said IBC;

and wherein the flexible fillable bag has an input port near the top of the said flexible fillable bag;

and wherein the flexible fillable bag adhered to the reinforcing board is folded atop said reinforcing board for deployment in the IBC.

2. The cartridge as in claim 1 wherein the fillable bag is a pillow bag.

3. The cartridge as in claim 1 wherein the height of the vertical panel of the reinforcing board is about 50 to 100 percent of the height of the IBC.

4. The cartridge as in claim 1 wherein the height of the vertical panel of the reinforcing board is about two-thirds of such height.

5. The cartridge as in claim 1 wherein the reinforcing board bottom panel will have a length from the fold line to the narrow edge and which corresponds to a distance from the center of the IBC base or bottom panel to the discharge panel.

6. The cartridge as in claim 1 wherein the long dimension of the reinforcing board corresponds to the sum of (a) the distance from the center of the IBC bottom panel to the side discharge panel and (b) the height of its vertical panel.

7. The cartridge as in claim 1 wherein the reinforcing board is about 30-50 percent of the width of the IBC side discharge panel.

8. The cartridge as in claim 7 wherein the reinforcing panel is about 40 percent of the width of the IBC side discharge panel.

9. The cartridge as in claim 1 wherein the reinforcing board is corrugated paperboard.

10. The cartridge as in claim 1 wherein the reinforcing board is adhered to the fillable bag with glue tape or plastic welds.

11. The cartridge as in claim 1 further comprising paper or plastic sacrificial tapes for stabilizing the folded fillable bag or folded cartridge assembly.

12. The cartridge as in claim 1 wherein the discharge fitting is a valve or port.

13. The cartridge as in claim 1 wherein the flexible fillable bag is folded atop the reinforcing board adhered thereto.

14. An intermediate bulk container having a geometry or shape comprising a fillable paperboard container and a cartridge for deploying a flexible fillable bag within said fillable paperboard container wherein said cartridge is further comprised of a flexible reinforcing board adhered to a generally flat and flexible fillable bag, wherein the fillable bag has a bottom and a top and has dimensions corresponding to a selected volume of liquid product it is intended to contain and the reinforcing board has dimensions corresponding to the geometry of the IBC, and said IBC has a side discharge panel having a height and a bottom, and said IBC has a discharge hole centered near the bottom of a side discharge panel, said discharge hole being configured to accommodate and secure a discharge fitting;

and wherein the reinforcing board is a rectangle having a fold line across its narrow dimension thereby defining only two sub-panel areas including a first or bottom panel adhered to a bottom edge of the fillable bag and configured to urge the bottom of said fillable bag to the bottom center of the IBC, and a second or vertical panel having a discharge fitting hole centered to correspond to the IBC side discharge panel, said vertical panel having a height of at least one-half the height of said side discharge panel and said vertical panel having a width of less than said side discharge panel;

and wherein said reinforcing board is configured to facilitate filling of said fillable bag deployed within said IBC and upon said IBC bottom panel permitting unfolding of said bottom of said fillable bag during a filling operation and is further configured to orient the fillable bag along the corresponding discharge side panel of said IBC;

and wherein the flexible fillable bag has an input port near the top of the said flexible fillable bag;

and wherein the flexible fillable bag adhered to the reinforcing board is folded atop said reinforcing board for deployment in the IBC.

* * * * *